US006120359A

United States Patent [19]

Ohno et al.

[11] Patent Number: 6,120,359

[45] Date of Patent: Sep. 19, 2000

[54] APPARATUS AND METHOD FOR FORMING SPHERICAL END SURFACE OF COAXIAL COMPOSITE MEMBER

[75] Inventors: Kenichi Ohno; Masashige Mitsuhashi, both of Tokyo, Japan

[73] Assignee: NEC Corporation, Tokyo, Japan

[21] Appl. No.: 09/191,872

[22] Filed: Nov. 12, 1998

[30] Foreign Application Priority Data

Nov. 12, 1997 [JP] Japan ..... 9-310950

[51] Int. Cl.[7] ..... B24B 1/00

[52] U.S. Cl. ..... 451/59; 451/533; 451/534; 451/535; 451/539

[58] Field of Search ..... 451/59, 533, 534, 451/535, 539

[56] References Cited

U.S. PATENT DOCUMENTS

| | | | |
|---|---|---|---|
| 4,922,675 | 5/1990 | Sato et al. | 451/539 |
| 5,738,576 | 4/1998 | Ohno et al. | 451/539 |

FOREIGN PATENT DOCUMENTS

| | | | |
|---|---|---|---|
| 0805374 | 11/1997 | European Pat. Off. | G02F 1/1343 |
| 56-139872 | 10/1981 | Japan | B24B 37/00 |
| 63-221958 | 9/1988 | Japan | B24B 19/00 |
| 5-4159 | 1/1993 | Japan | B24B 19/00 |
| 6-202073 | 7/1994 | Japan | G02F 1/133 |
| 7-314309 | 12/1995 | Japan | B24B 19/00 |
| 929599 | 2/1997 | Japan | B24B 19/00 |
| 9-197420 | 7/1997 | Japan | G02F 1/1343 |
| 9-248771 | 9/1997 | Japan | B24D 11/00 |
| 9-272051 | 10/1997 | Japan | B24B 19/00 |
| 10-113854 | 5/1998 | Japan | B24B 19/00 |

*Primary Examiner*—David A. Scherbel
*Assistant Examiner*—Shantese McDonald
*Attorney, Agent, or Firm*—Hayes, Soloway, Hennessey, Grossman & Hage, P.C.

[57] ABSTRACT

The invention provides an apparatus and a method for forming the end surface of a coaxial composite member consisting of a cylindrical member and an axial member, in which the axial member is ground more readily than the cylindrical member, being capable of forming the end surface of the coaxial member into a convexed spherical mirror surface with high precision, without recession of the axial member from the formed spherical surface. The apparatus for forming the end surface of a coaxial composite member comprises a grinding table having a circularly recessed guide surface, a winding motor for running a grinding tape across the circularly recessed guide surface, a pressing member for pressing the coaxial composite member on the grinding tape to be then contacted with the circularly recessed guide surface, and a rotating motor for providing the coaxial composite member on the grinding tape with rotative movement on its axis and reciprocative movement in the direction orthogonal to the running direction of the grinding tape, wherein the recessed guide surface in provided with a recess or a member having lower hardness than that of the material for the recessed guide surface, on the median line thereof.

20 Claims, 7 Drawing Sheets

APPARATUS AND METHOD FOR FORMING SPHERICAL END SURFACE OF COAXIAL COMPOSITE MEMBER

FIELD OF THE INVENTION

This invention relates to an apparatus and a method for forming a spherical end surface of a coaxial composite member, and more particularly to an apparatus and a method for forming a spherical surface at the end of a coaxial composite member composed of a cylindrical member having a circular cross-section, such as an optical connector ferrule, and an axial member such as an optical fiber inside the cylindrical member coaxially therewith, in which the axial member is more readily ground than the cylindrical member.

BACKGROUND OF THE INVENTION

Transmission of an optical signal through optical fibers connected in series with each other suffers from optical loss and reflection caused by the gap between the terminal surfaces of the fibers. In a method widely used for connecting optical fibers with lowered optical loss, the terminal surface of the connector for connecting the optical fibers is formed to be spherically projected and polished to form a mirror surface so that the terminal surfaces of optical fibers are contacted closely with each other.

A conventional apparatus used for forming the end surface of an optical connector into a spherical mirror surface is composed of a grinding table having a circularly recessed guide surface, a grinding tape running across the recessed guide surface (in the tangential direction), means for pressing the end surface of the optical connector onto the recessed guide surface of the grinding table with the grinding tape interposed therebetween, means for drawing the grinding tape across the curvature of the recessed guide surface, means for rotating the optical connector around its axis, and means for moving the optical connector in the direction orthogonal to the running direction of the grinding tape while the optical connector is rotated.

For forming the end surface of an optical connector into a spherical mirror surface using the conventional apparatus, the end surface of the optical connector is pressed onto the recessed guide surface of the grinding table with the grinding tape interposed therebetween, the grinding tape drawn by the drawing means is allowed to run across the curvature of recessed guide surface and, at the same time, the optical connector is rotated around its axis and moved back and forth in the direction orthogonal to the running direction of the grinding tape, by the rotating means and the moving means, respectively, thereby the end surface of the optical connector pressed on the curved surface of the grinding table is finished to form a mirror spherical surface by the help of the grinding tape.

For connecting optical fibers by means of an optical connector, an optical fiber is inserted into a ferrule and fixed to the ferrule with some adhesive.

When the end surface of an optical connector is formed into a spherical mirror surface by the use of the conventional apparatus mentioned above, however, there often arises a problem in which the end of optical fiber is receded from the end surface of the optical connector, because the optical fiber is ground more readily than the ferrule around the optical fiber. This recession may cause failure in close contact of the optical fibers with each other at their ends.

SUMMARY OF THE INVENTION

Accordingly, it is an object or the invention to provide an apparatus for forming into a spherical mirror surface the end surface of a coaxial composite member consisting of a cylindrical member having a coaxial bore extending therethrough, and an axial member inserted into the coaxial bore of the cylindrical member, in which the axial member is ground more readily than the cylindrical member, while avoiding the recession of the end of the axial member from the formed spherical surface.

It is another object of the invention to provide a method for forming into a spherical mirror surface the end surf ace of a coaxial composite member consisting of a cylindrical member having a coaxial bore extending therethrough, and an axial member inserted into the coaxial bore of the cylindrical member, in which the axial member is ground more readily than the cylindrical member, while avoiding the recession of the end of the axial member from the formed spherical surface.

According to the first feature of the invention, an apparatus for forming into a spherical mirror surface the end surface of a coaxial composite member consisting of a cylindrical member having a coaxial bore extending therethrough, and an axial member inserted into the coaxial bore of the cylindrical member, in which the axial member is ground more readily than the cylindrical member. comprises:

- a grinding table having a circularly recessed guide surface provided with a recess on the median line thereof, the recess having a predetermined length and a width determined by the diameter of said axial member;
- means for running the grinding tape across the circularly recessed guide surface;
- means for pressing the coaxial composite member on the grinding tape to be then contacted with the circularly recessed guide surface of the grinding table; and
- means for providing the coaxial composite member pressed on the grinding tape with rotative movement on its axis and reciprocative movement in the direction orthogonal to the running direction of the grinding tape.

According to the second feature of the invention, an apparatus for forming into a spherical mirror surface the end surface of a coaxial composite member consisting of a cylindrical member having a coaxial bore extending therethrough, and an axial member inserted into the coaxial bore of the cylindrical member, in which the axial member is ground more readily than the cylindrical member, comprises;

- a grinding table having a circularly recessed guide surface provided with a recess on the median line thereof, the recess having a predetermined length and a width determined by the diameter of said axial member, the circularly recessed guide surface being filled with a member having a hardness lower than the material of the grinding table;
- means for running the grinding tape across the circularly recessed guide surface;
- means for pressing the coaxial composite member on the grinding tape to be then contacted with the circularly recessed guide surface of the grinding table; and
- means for providing the coaxial composite member pressed on the grinding tape with rotative movement on its axis and reciprocative movement in the direction orthogonal to the running direction of the grinding tape.

According to the third feature of the invention, a method for forming into a spherical mirror surface the end surface of a coaxial composite member consisting of a cylindrical member having having a coaxial bore extending therethrough, and an axial member inserted into the coaxial bore of the cylindrical member, in which the axial member is ground more readily than the cylindrical member, comprises:

providing a circularly recessed guide surface;

running a grinding tape across the circularly recessed guide; and pressing the coaxial composite member on the grinding tape to be then contacted with the circularly recessed guide surface, while rotating the coaxial composite member on its axis on the grinding tape and moving the coaxial composite member reciprocatively on the grinding tape in the direction orthogonal to the running direction of the grinding tape: wherein the step of running the grinding tape comprises the step of fixing grains of $SiO_2$ on a tape substrate to provide the grinding tape; and the step of pressing the coaxial composite member comprises the step of applying a pressing force equal to or greater than $10^4$ gf/cm$^2$ to the coaxial composite member.

In the invention, the apparatus for forming into a spherical mirror surface the end surface of a coaxial composite member consisting of a cylindrical member having a circular cross-section and an axial member provided coaxially inside the cylindrical member, in which the axial member is ground more readily than the cylindrical member, is characterized by having a grinding table provided with a recess or a member of lower hardness than that of the grinding table on the median line of the recessed guide surface. The recess or the member of lower hardness than that of the grinding table, provided on the median line of the recessed guide surface, reduces the force applied to the axial member of the coaxial composite member, thereby recession of the axial member, such as an optical fiber, from the formed spherical surface due to the force applied thereto during the forming process is prevented.

A grinding tape is coated with grinding grains of a material =such as SiC, diamond, $CeO_2$, $SiO_2$, etc. on the surface facing the end surface of a coaxial composite member to be spherically formed.

It is preferred that the grinding tape in coated with $CeO_2$ grinding grains, particularly for forming the end surface of the coaxial composite member having the axial member consisting of $SiO_2$, such as an optical fiber, because more precise forming is accomplished compared to other grains owing to some chemical reaction with $SiO_2$.

In the invention, the method for forming into a spherical mirror surface the end surface of a coaxial composite member consisting of a cylindrical member having a circular cross-section and an axial member provided coaxially inside the cylindrical member, in which the axial member is ground more readily than the cylindrical member, is characterized by the use of a grinding tape coated with $SiO_2$ grains and the pressure of at least 10 kgf/cm$^2$ applied to the coaxial composite member axially, thereby recession of the coaxial member consisting of $SiO_2$, such as an optical fiber, from the formed spherical surface due to the force applied thereto during the forming process is prevented.

BRIEF DESCRIPTION OF THE DRAWINGS

The invention will be described in more detail in conjunction with the accompanying drawings, wherein.

DESCRIPTION OF THE PREFERRED EMBODIMENTS

Before explaining preferred embodiments of the invention, an optical connector and a conventional apparatus for forming the end surface of an optical connector into a spherical mirror surface will be explained with reference to FIG. 1 and FIG. 2.

Figure 1:
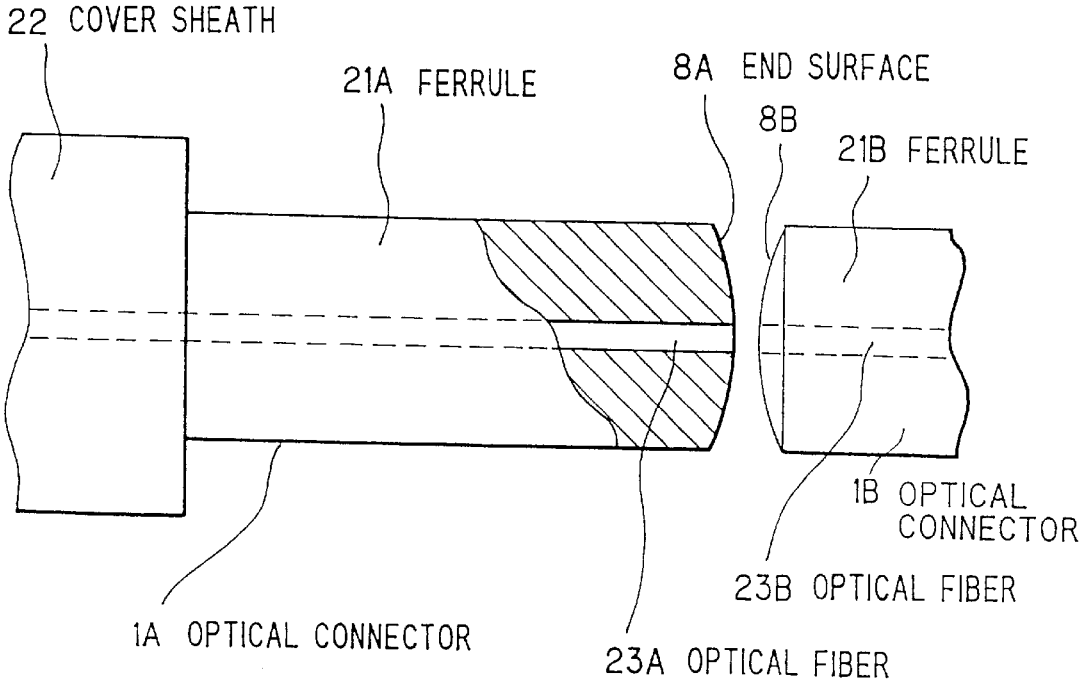
FIG. 1 is a cross-sectional view of an optical connector.

FIG. 1 shows an optical connector for coupling two optical fibers. Optical coupler 1A composed of ferrule 21A with optical fiber 23A inserted into its axial bore. End surfaces 8A and 8B of optical connectors 1A and 13 for connecting optical fibers 23A and 23B should be formed to be spherically projected with Surfaces polished like a mirror. The ferrules 21A and 215 are connected to be axially aligned by a sleeve (not shown) provided between cover sheaths 22 and on the ferrules 21A and 21B.

Figure 2:
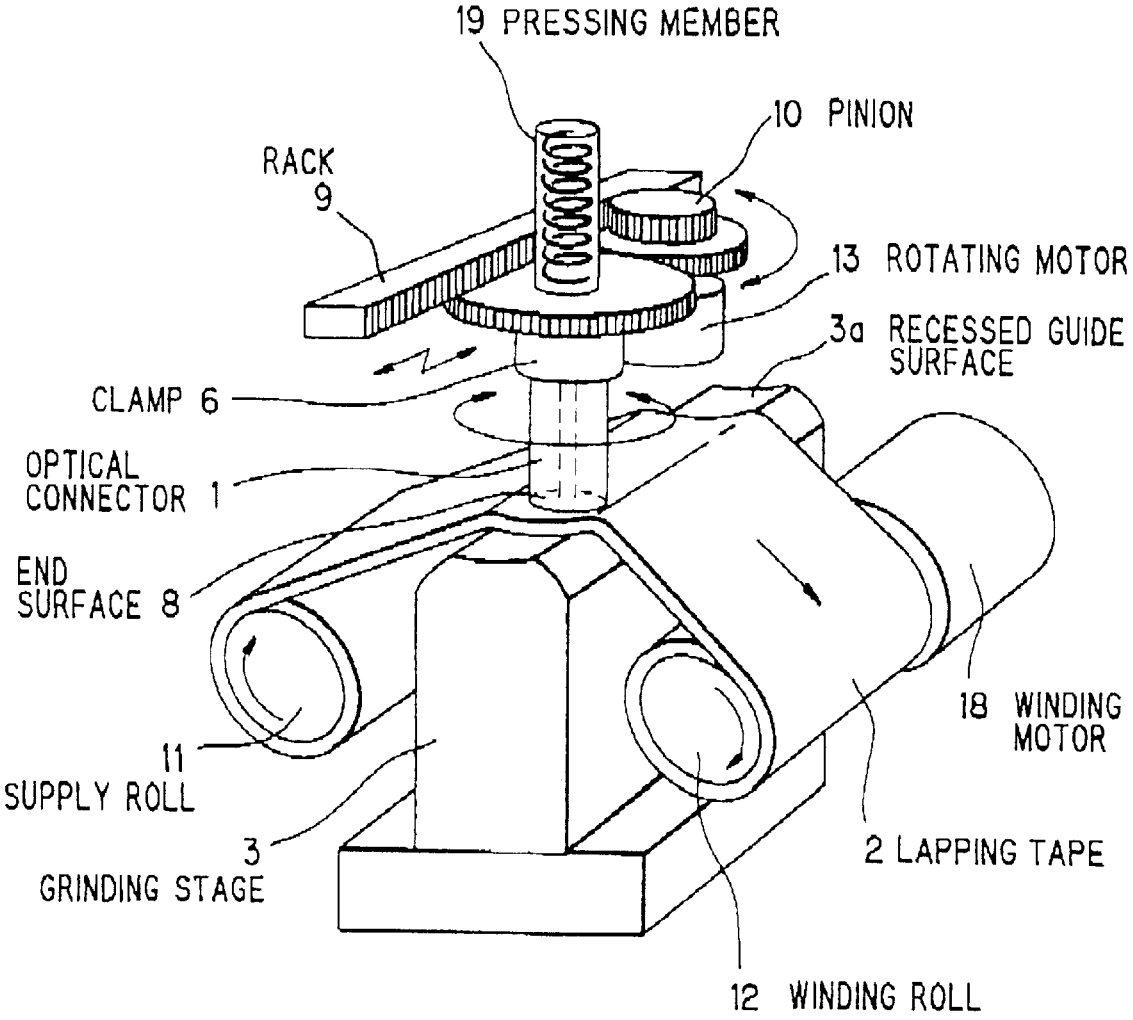
FIG. 2 PRIOR ART
FIG. 2 is a perspective view of a conventional apparatus for forming the end surface of an optical connector into a spherical mirror surface.

FIG. 2 shows a conventional apparatus for forming the end surface of an optical connector, which is an example of a coaxial composite member, into a spherical mirror surface, disclosed in the specification of the Japanese Patent Application Hei No.7-207646. The apparatus shown in FIG. 2 is provided with grinding table 3 having circularly recessed guide surface 3*a*, grinding tape 2 running across recessed guide surface 3*a*, pressing member 19 for pressing end surface 8 of optical connector 1 to recessed guide surface 3*a*, with grinding tape 2 interposed therebetween, winding motor 18 serving as means for drawing grinding tape 2 across recessed guide surface 3*a*, rotating motor 13 serving as means for rotating optical connector 1 around its axis, and rack 9 and pinion 10 serving as means for moving optical connector 1 in the direction orthogonal to the direction of drawing of the grinding tape 2 while optical connector 1 is rotated.

For forming end surface 8 of optical connector 1 into a spherical mirror surface using the conventional apparatus shown in FIG. 2, end surface 8 of optical connector 1 is pressed onto recessed guide surface 3*a* of grinding table 3, with grinding tape 2 interposed therebetween, grinding tape 2 drawn by winding motor 18 is allowed to run over the curvature of recessed guide surface 3*a* and, at the same time, optical connector 1 is rotated around its axis by rotating motor 13 serving as the rotating means and moved back and forth in the longitudinal direction of recessed guide surface 3*a* by rack 9 and pinion 10 serving as the moving means, thereby end surface 8 of optical connector 1 pressed on the recessed guide surface 3*a* of grinding table 3 is finished to have a spherical mirror surface by the help of grinding tape 2.

The preferred embodiments of apparatus for forming the end surface of a coaxial composite member according to the invention will be explained in detail with reference to FIG. 3 to FIG. 8.

Figure 3:
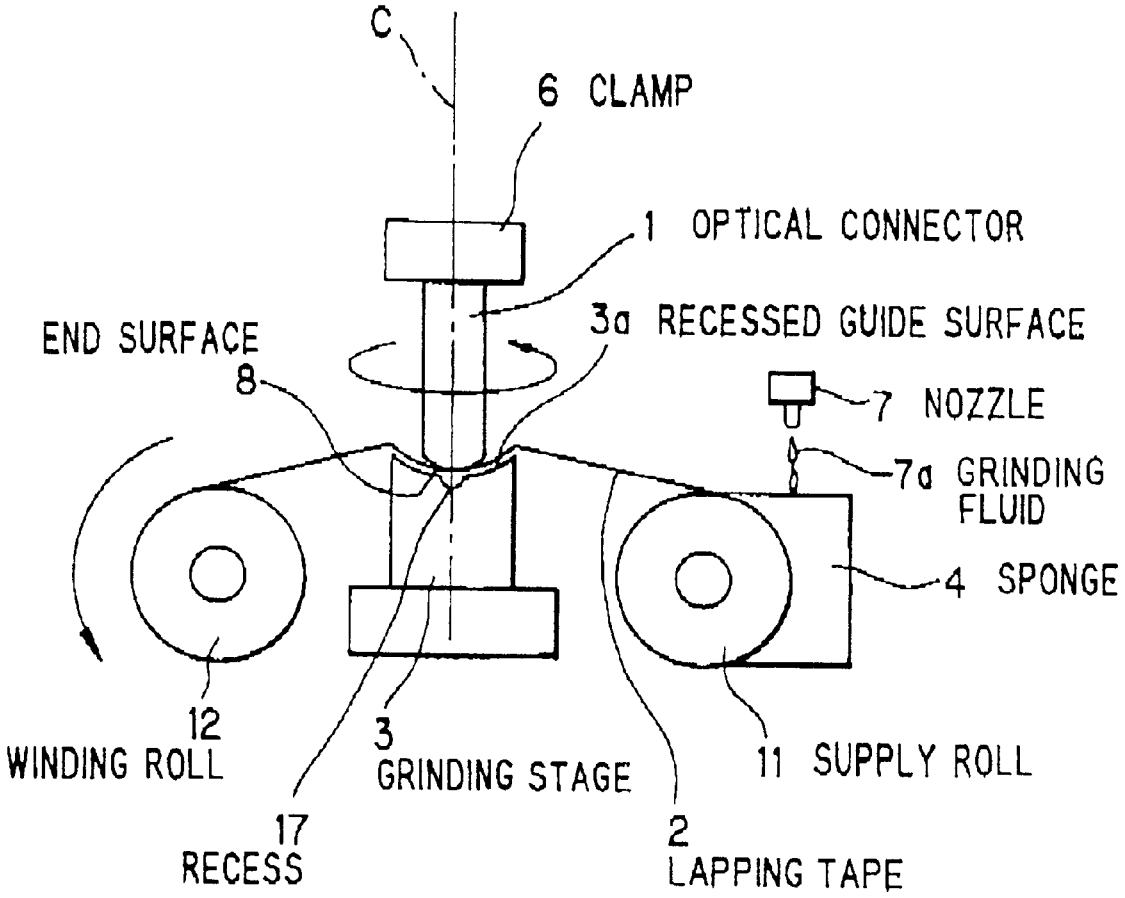
FIG. 3 is an explanatory view of the first preferred embodiment of an apparatus for forming the end surface of a coaxial composite member according to the invention.
Figure 4:
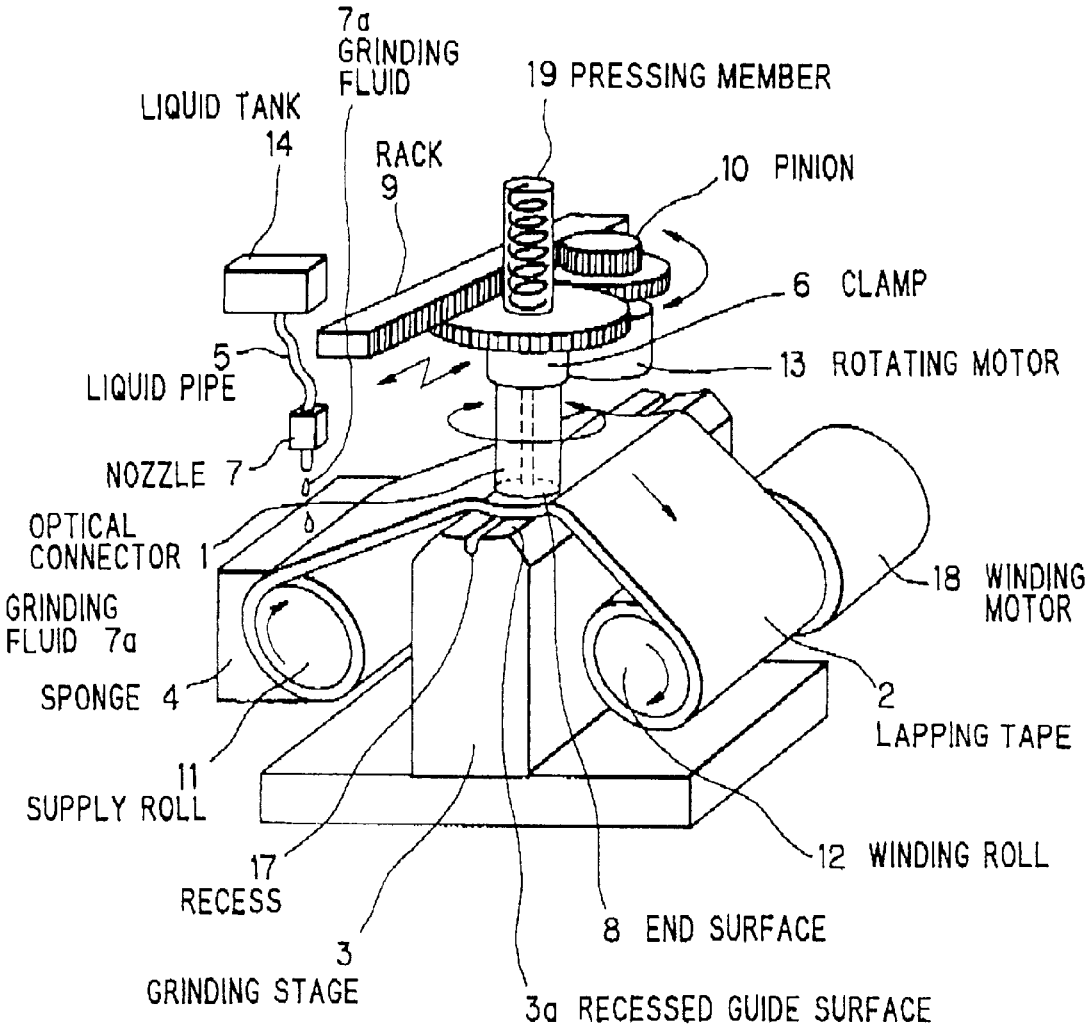
FIG. 4 is a perspective view of the first preferred embodiment of an apparatus for forming the end surface of a coaxial composite member according to the invention.

FIG. 3 and FIG. 4 (viewing sides are different) show the first preferred embodiment of apparatus for forming the end surface of a coaxial composite member according to the invention. The apparatus for forming the end surface of a coaxial composite member shown in FIGS. 3 and 4 is provided with grinding table 3 having recessed guide surface 3*a*, grinding tape 2 running along the curvature (in the tangential direction) of recessed guide surface 3*a*, pressing member 19 for pressing end surface 8 of optical connector 1 onto recessed guide surface 3*a*, with grinding tape 2 interposed therebetween tape winding motor 18 serving as means for drawing grinding tape 2 over recessed guide surface 3*a*, rotating motor 13 serving as means for rotating optical connector 1 around its axis, and rack 9 and pinion 10 serving as means for moving optical connector 1 in the longitudinal direction of recessed guide surface 3*a* while optical connector 1 is rotated.

Sponge 4 is pressed onto grinding tape 2, from which a grinding liquid 7*a* dropped from nozzle 7 is supplied to grinding tape 2. Grinding table 3 is provided with recess 17 having a semi-circular cross-section extended along the median line of recessed guide surface 3*a*. Recess 17 should have a width not less than the diameter of optical fiber (23A or 23B in FIG. 1) inserted into the bore of optical connector ferrule 21A.

In the apparatus shown in FIGS. 3 and 4, optical connector 1 composed of a ferrule (21A or 21B in FIG. 1) of 2.5 mm in diameter consisting of zirconia is used, into the bore of which an optical fiber (23A or 23B in FIG. 1) of 125 microns in diameter is inserted. Grinding table 3 is formed of Teflon, the diameter of curvature of recessed guide surface 3*a* being 17.5 mm. the width of recess 17 being 125 microns, the diameter of curvature of recess 17 being 62.5 microns. Grinding tape 2 used has a winding length of 150 m with a width of 25 mm and a substrate thickness of 25 microns, and is coated with SiC grinding grains of 8 microns in diameter (to be explained in FIG. 7).

Operation of the apparatus shown in FIGS. 3 and 4 will be explained below. The axis C of optical connector 1 is aligned with the median line of recessed guide surface 3*a* of grinding table 3. Then, end surface 8 of optical connector 1 is pressed onto recessed guide surface 3*a*, with grinding tape 2 interposed therebetween, by means of pressing member 19. In this state, grinding tape 2 supplied from supply roll 11 is drawn over the curvature (in the tangential direction) of recessed guide surface 3*a* at a low velocity, being wound by winding roll 12 driven by winding motor 18, and optical connector 1 is rotated with clamp 6 fixed thereto by rotation of rotating motor 13. The rotation of rotating motor 13 is converted to linear movement of optical connector 1 in the longitudinal direction of recessed guide surface 3*a* by means of rack 9 and pinion 10, thereby optical connector 1 is moved back and forth in the longitudinal direction of recessed guide surface 3*a* by backward and forward driving of rotating motor 13, while optical connector 1 is rotated around axis C of rotation simultaneously.

While grinding tape 2 is running, grinding liquid 7*a* is supplied from sponge 4 pressed to grinding tape 2, thereby a uniform thin layer of grinding liquid 7*a* is formed on the surface of grinding tape 2. End surface 8 of optical connector 1 is formed roughly into a convexed spherical surface while it is rotated and moved linearly back and forth. After this preliminary working is finished and grinding tape 2 is wound up on winding roll 12 to its end, grinding tape 2 is replaced by new one (preferably having more fine grains) and optical connector 1 is subject to finishing work. End surface 8 of optical connector 1 is ground gradually into more smooth convexed spherical surface by grinding. As recess 17 is formed along the median line of recessed guide surface 3*a*, the force applied to optical fiber (23A and 23B in FIG. 1) in the course of forming work is smaller than that to the ferrule (21A and 21B in FIG. 1), whereby no recession of the optical fiber from end surface 8 occurs.

In this preferred embodiment, a perpendicular force of 150 gf is applied to optical connector 1, pure water of 10 cc in every 90 minutes is supplied to sponge 4 from nozzle 7, and clamp 6 is rotated at 400 rpm during the preliminary work for 90 seconds. After the preliminary work is applied continuously to 1000 optical connectors, grinding tape 2 is renewed to continue finishing work, wherein each work is conducted for 90 seconds under the same condition as in the preliminary work.

One thousand optical connectors are worked in a Continued work in this embodiment. The time required for forming end surface of each optical connector is 3.5 minutes including the time required to replace an optical connector with another one. A spherical mirror surface with a diameter of curvature of 17.5±1 mm, so precise and smooth as having surface coarseness of 0.01 microns or less, is obtained. Recession of optical fiber from end surface 8 of optical connector 1 is so small as 0.05 microns or less. Thereby, optical coupling loss of 0.28 db or less and reflection attenuation of 45 db or more are obtained.

Figure 5:
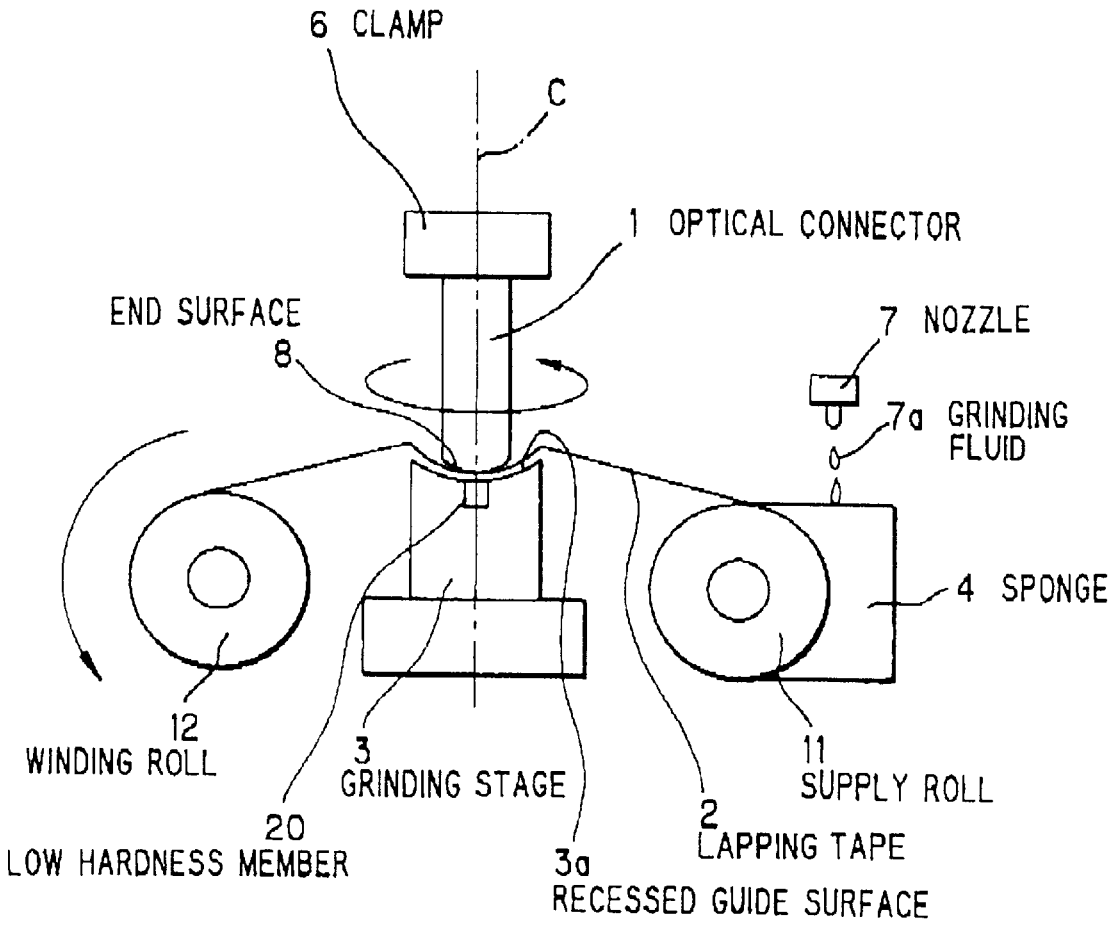
FIG. 5 is an explanatory view of the second preferred embodiment of an apparatus for forming the end surface of a coaxial composite member according to the invention.
Figure 6:
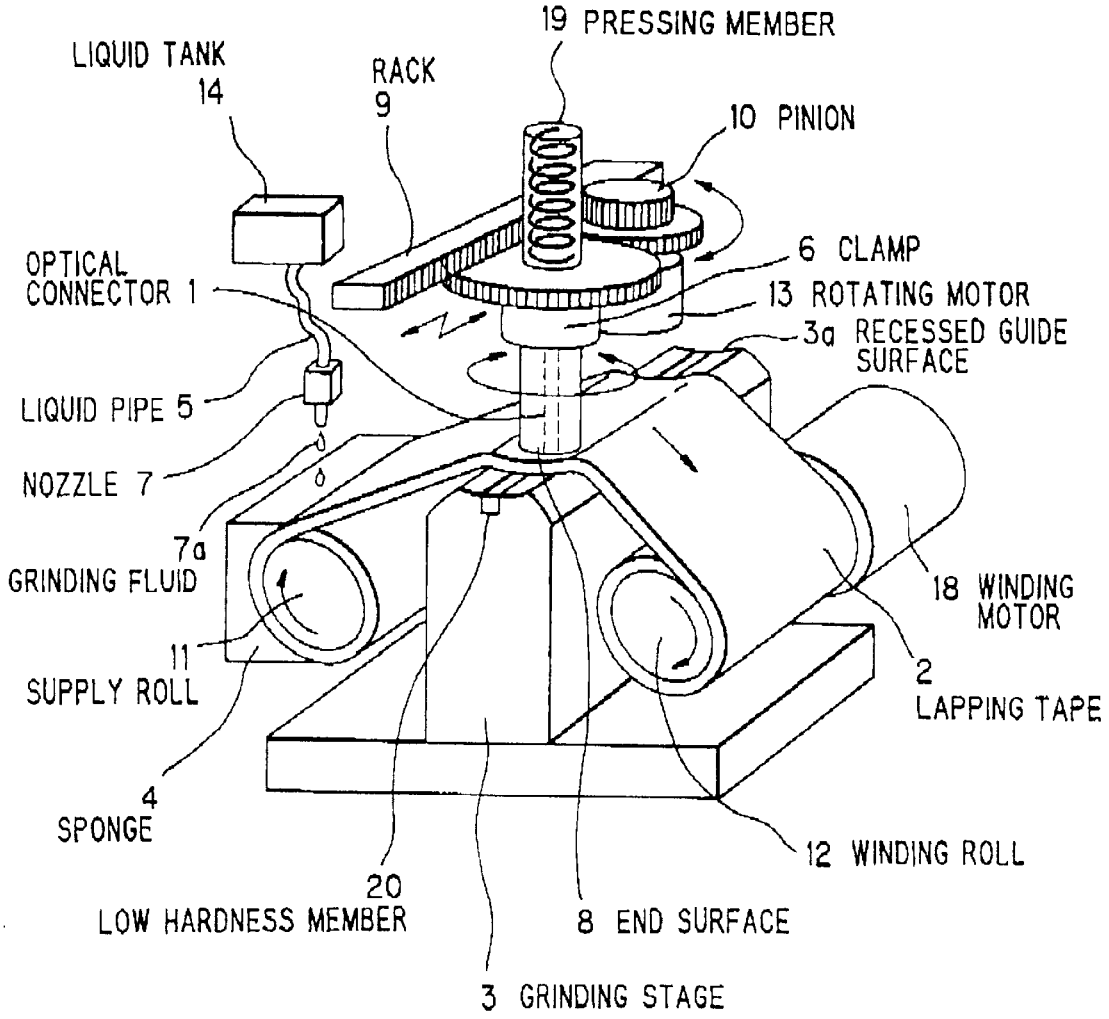
FIG. 6 is a perspective view of the second preferred embodiment of an apparatus for forming the end surface of a coaxial composite member according to the invention.

FIG. 5 is an explanatory view of the second preferred embodiment of apparatus for forming spherical end surface of a coaxial composite member according to the invention. FIG. 6 is a perspective view thereof. The apparatus for forming the spherical end surface of a coaxial composite member in the second preferred embodiment is provided with a member of lower hardness than that of the grinding table along the median line of the recessed guide surface.

In this embodiment, low hardness member 20 is provided along the median line of recessed guide surface 3*a*, low hardness member 20 being formed of a material such as rubber which has a hardness lower than that of the material for recessed guide surface 3*a* of grinding table 3. Low hardness material 20 should have a width not smaller than the optical fiber (23A and 23B in FIG. 1).

End surface 8 of optical connector 1 is pressed onto recessed guide surface 3*a*, with grinding tape 2 interposed therebetween and with the axis C of optical connector 1 aligned with the median line of recessed guide surface 3*a*. End surface 8 of optical connector 1 is formed into a spherical surface by carrying grinding tape 2 over the curvature (in the tangential direction) of recessed guide surface 3*a* at low speed while optical connector 1 is rotated around its axis and slid in the longitudinal direction of recessed guide surface 3*a*.

Grinding table 3 is formed of Teflon, the diameter of curvature of recessed guide surface 3*a* is 17.5 mm and recess 17 has a width of 125 microns and a diameter of curvature of 62.5 microns. Grinding tape 2 having a winding length of 150 meters, a width of 25 mm and a substrate thickness of 25 microns is used, on which SiC grains of 8 microns in diameter are fixed. Optical connector 1 consists of a ferrule of 2.5 mm in diameter composed of zirconia particles, into a bore of which optical fiber of 125 microns in diameter is inserted. The gear ratio of gears, one fixed to rotating motor 13 to the other fixed to clamp 6, is 2 to 1 so that optical connector 1 may rotate twice by every turn of rotating motor 13.

The force of 150 gf is applied to optical connector 1 in the axial direction by means of pressing member 19. Pure water of 10 cc in every 90 minutes is supplied to sponge 4 from nozzle 7, and clamp 6 is rotated at 400 rpm during the preliminary work for 90 seconds.

After the preliminary work is applied continuously to 1000 optical connectors, grinding tape 2 is renewed for finishing work, wherein each work is conducted for 90 seconds in the same condition as in the preliminary work.

Figure 7:
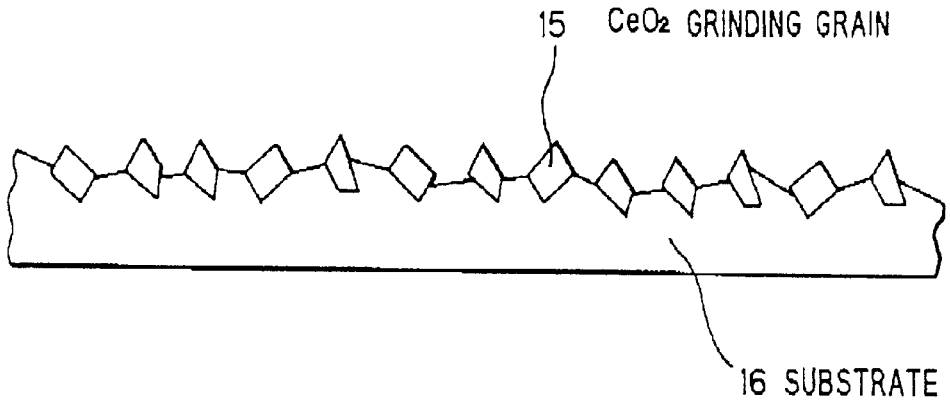
FIG. 7 is a cross-sectional view of the grinding tape coated with $CeO_2$ used in the third preferred embodiment of the invention.

One thousand optical connectors are worked in a continued work in this embodiment. The time required for forming end surface 8 of each optical connector is 3.5 minutes including the time required to replace an optical connector to another one. A spherical mirror surface with a diameter of curvature of 17.5±1 mm, so precise and smooth as having surface coarseness of 0.01 microns or less, is obtained. Recession of optical fiber from end surface 8 of optical connector 1 is found to be so small as 0.05 microns or less. Thereby, optical coupling loss of 0.28 db or less and reflection attenuation of 45 db or more are obtained. FIG. 7 is a cross-sectional view of a grinding tape coated with $CeO_2$ grinding grains on its surface and it is used in the third preferred embodiment of the invention. The apparatus shown in FIG. 5 and 6 is used in this embodiment.

End surface 8 of optical connector 1 is formed in the preliminary work roughly into a spherical surface in a manner similar to that of the first and second preferred embodiments, and polished in the finishing work into a spherical mirror surface by the use of grinding tape 2 coated with $CeO_2$ as shown in FIG. 7. Because $CeO_2$ is subject to a chemical reaction with $SiO_2$, optical fibers formed of $SiO_2$ can be ground more readily by using a $CeO_2$ coated tape than tapes coated with other materials. Thus, end surface 8 of optical connector 1 is formed more precisely into a spherical surface without recession of the optical fiber therefrom.

Grinding table 3 is formed of Teflon, the diameter of curvature of recessed guide surface 3*a* is 17.5 mm, and low hardness member 20 formed of rubber has a width of 125 microns. Grinding tape 2 having a winding length of 150 meters, a width of 25 mm and a substrate thickness of 25 microns is used. Grinding tape 2 coated with SiC grains of 8 microns in diameter is used for preliminary work and grinding tape 2 coated with $CeO_2$ grains is used for finishing work. Optical connector 1 consists of a ferrule of 2.5 mm in diameter composed of zirconia particles, an optical fiber of 125 microns in diameter being inserted therein.

The force applied to optical connector 1 axially, the supply of water to sponge 4 from nozzle 7, rotation of clamp 6 and duration of time for preliminary and finishing works are the same as in the second preferred embodiment. After 1000 optical connectors are processed in the preliminary work, grinding tape 2 is replaced by a grinding tape coated with $CeO_2$ grains of 8 microns in diameter to apply the finishing work to 1000 optical connectors.

One thousand optical connectors are worked in a continued work in this embodiment, too. The time required for forming end surf ace of each optical connector is 3.5 minutes including the time required for replacement of optical connectors. The diameter of curvature of spherical mirror surface formed is 17.5±1 mm, equal to that of recessed guide surface 3*a*. The spherical surface so precise and smooth as having surface coarseness of 0.01 microns or less is obtained. Recession of the optical fiber from end surface 8 of optical connector 1 is found to be so small as 0.05 microns or less. Optical coupling loss of 0.20 db or less and reflection attenuation of 47 db or more are obtained.

Figure 8:
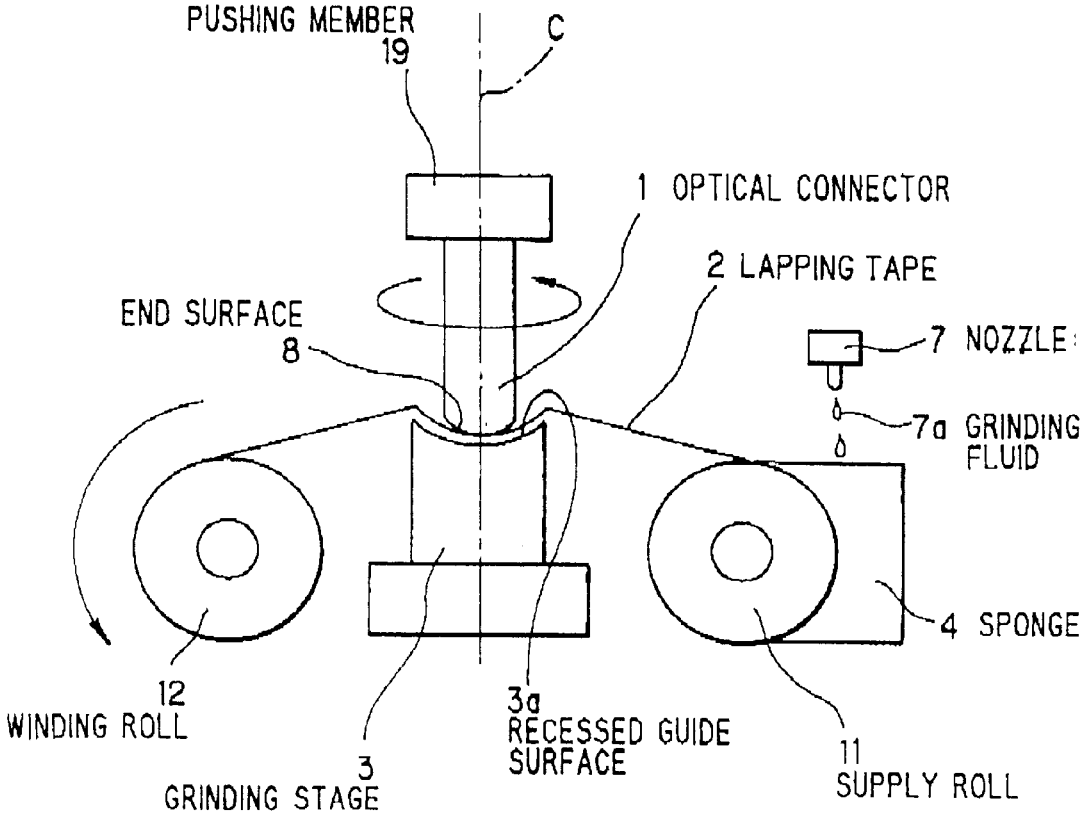
FIG. 8 is an explanatory view of the apparatus for forming the end surface of a coaxial composite member used in the fourth preferred embodiment of the invention.

FIG. 8 shows the apparatus for forming an end surface of a coaxial composite member used in the fourth preferred embodiment of the invention. Grinding tape 2 used in this apparatus is coated with $SiO_2$ grains. The apparatus for forming the end surface of a coaxial composite member shown in FIG. 8 is essentially similar to a conventional apparatus used for the same purpose, except that it is provided with a grinding tape coated with $SiO_2$ grains. The material of grinding table 3, the width and the diameter of curvature of recessed guide surface 3*a*, the length, width and substrate thickness of grinding tape 2, and the composition of grinding liquid 7*a* are the same as that in the first preferred embodiment.

Operation of the apparatus shown in FIG. 8 is similar to that of the apparatus shown in FIG. 3, except no provision of recess 17. End surface 8 of optical connector 1 is pressed onto-recessed guide surface 3*a* with a force of 500 gf applied axially to optical connector 1 by means of pressing member 19, with grinding tape 2 interposed therebetween and with the axis C of optical connector 1 aligned with the median line of recessed guide surface 3*a*. End surface a of optical connector 1 is formed into a spherical surface by carrying grinding tape 2 over the curvature of recessed guide surface 3*a* at low speed while optical connector 1 is rotated around its axis and slid along recessed guide surface 3*a* in the longitudinal direction thereof. Grinding tape 2 unwound from supply roll 11 is drawn by winding roll 12, running over recessed guide surface 3*a*. Grinding liquid 7*a* is supplied from nozzle 7 to sponge 4 which is brought into contact with grinding tape 2. The rate of supply of grinding liquid 7*a*, the rate of rotation of optical connector 1, and the duration of time for preliminary and finishing works are the same as in the first preferred embodiment.

After end surface 8 of optical connector 1 is formed roughly into a spherical surface by preliminary work, grinding tape 2 is wound up to its end and replaced by new one coated also with $SiO_2$, and the grinding operation is continued to conduct finishing work.

Because a grinding tape coated with $SiO_2$ grains is used in this embodiment, workability of the optical fiber (23A or 23B in FIG. 1) inserted into optical connector 1 is reduced, thus recession of the optical fiber from end surface 8 can be prevented, enabling work with larger force, thus, degree of working to be increased, thereby the quality of end surface can be improved.

One thousand optical connector are worked in a continued work in this embodiment, too. The time required for forming end surface of each optical connector is 3.5 minutes including the time required to replace an optical connector to another one. A spherical mirror surface with a diameter of curvature of 17.5±1 mm, so precise and smooth as having surface coarseness of 0.01 microns or less in Rmax, is obtained. Recession of optical fiber 23 from end surface 8 of optical connector 1 is found to be so small as 0.05 microns or less. Thereby, optical coupling loss of 0.28 db or less and reflection attenuation of 45 db or more are obtained.

In the following, the fifth preferred embodiment of the invention will be explained in detail. The apparatus shown in FIG. 3 and FIG. 4 is used in this embodiment.

The material of grinding table 3 (Teflon), the diameter of curvature of recessed guide surface 3*a* (17.5 mm), the width (125 microns) and the diameter of curvature (62.5 microns)

of recess 17, the winding length, the width and the substrate thickness of grinding tape 2 (150 meters, 25 mm, 25 microns, respectively). the diameter of optical fiber (125 microns), the force applied axially to optical connector 1 (150 gf), the rate of rotation of optical connector 1 (400 rpm), the use of water as the grinding liquid, and the amount of water supplied to sponge 4 (10 cc in every 90 minutes) are the same as that in the first preferred embodiment. Optical connector 1 having ferrule of 2.5 mm in diameter composed of zirconia is used. Grinding tape 2 coated with SiC grains of 8 microns in diameter is used for preliminary work and grinding tape 2 coated with $CeO_2$ grains, similar to that used in the third preferred embodiment, is used for finishing work.

End surface 8 of optical connector 1 is pressed on recessed guide surface 3*a*, with grinding tape 2 interposed therebetween, and with the axis C of optical connector 1 aligned with the median line of recessed guide surface 3*a*. End surface 8 of optical connector 1 is formed into a spherical surface by carrying grinding tape 2 over the curvature of recessed guide surface 3*a* at low speed while optical connector 1 is rotated around its axis and slid over grinding tape 2 pressed on recessed guide surface 3*a* in the direction orthogonal to the direction of carrying of grinding tape 2. Optical connector 1 is processed in the preliminary work for 90 seconds.

After this preliminary work is applied continuously to 1000 optical connectors, grinding tape 2 is replaced by $CeO_2$-coated tape to conduct finishing work, wherein each work is conducted for 90 seconds in the same conditions as the preliminary work except the grinding tape.

One thousand optical connectors are worked in a continued work in this embodiment. The time required for forming end surface of each optical connector is 3.5 minutes including the time required to replace an optical connector to another one. A spherical mirror surface with a diameter of curvature of 17.5±1 mm, so precise and smooth as having surface coarseness of 0.01 microns Rmax or less, is obtained. Recession of optical fiber from end surface 8 of optical connector 1 is found to be so small as 0.05 microns or less. Thereby, optical coupling loss of 0.2 db or less and reflection attenuation of 47 db or more are obtained.

Although the invention has been described in detail with respect to the specific embodiments, the invention is not limited to these embodiments. For example, grinding tapes coated with Sic grains are used for preliminary work, but grinding tapes coated with $Al_2O_3$/diamond grains may be used with a comparative results.

Further, this invention can be applied to any coaxial composite member consisting of a cylindrical member having a coaxial bore extending therethrough and an axial member inserted into the coaxial bore of the cylindrical member, in which the axial member is ground more readily than the cylindrical member, other than the optical connectors described above.

As described above, the apparatus for forming the end surface of a coaxial composite member consisting of a cylindrical member and an axial member, in which the axial member is ground more readily than the cylindrical member, according to the invention, is capable of forming the end surface of the coaxial member into a convexed spherical mirror surface with high precision without recession of the coaxial member from the formed spherical surface.

Further, the method for forming the end surface of a coaxial composite member consisting of a cylindrical member and an axial member, in which the axial member is ground more readily than the cylindrical member, according to the invention, is capable of forming the end surface of the coaxial member into a convexed spherical mirror surface with high precision without recession of the coaxial member from the formed spherical surface.

Although the invention has been described with respect to the specific embodiments for complete and clear disclosure, the appended claims are not to be thus limited but are to be construed as embodying all modification and alternative constructions that may occur to one skilled in the art which fairly fall within the basic teaching herein set forth.

What is claimed is:

1. An apparatus for forming a spherical end surface of a coaxial composite member comprising a cylindrical member having a coaxial bore extending therethrough, and an axial member inserted into said coaxial bore of said cylindrical member to be more readily ground than said cylindrical member, comprising:

a fixedly positioned elongated grinding table of finite length having a circularly recessed guide surface provided with a recess on the median line thereof, said recess having a predetermined length and a width determined by the diameter of said axial member;

a winding motor for running a grinding tape across said circularly recessed guide surface;

a pressing member for pressing said coaxial composite member on said grinding tape to be then contacted with said circularly recessed guide surface; and a rotating motor for providing said coaxial composite member on said grinding tape with rotative movement on its axis and reciprocative movement in the direction orthogonal to the running direction of said grinding tape.

2. The apparatus as defined in claim 1, wherein:

said recess of said circularly recessed guide surface of said grinding table is filled with a member having a hardness lower than the material of said grinding table.

3. The apparatus as defined in claim 1, wherein:

said coaxial composite member is an optical connector; and said cylindrical member is a ferrule of said optical connector, and said axial member is an optical fiber.

4. The apparatus as defined in claim 1, wherein:

said grinding tape is coated with $CeO_2$ grinding grains on the surface facing the end surface of said coaxial composite member.

5. The apparatus as defined in claim 1, wherein:

said grinding tape is coated with SiC grinding grains on the surface facing the end surface of said coaxial composite member.

6. The apparatus as defined in claim 1, wherein:

said grinding tape is coated with diamond grinding grains on the surface facing the end surface of said coaxial composite member.

7. The apparatus as defined in claim 1, wherein:

said grinding tape is coated with $SiO_2$ grinding grains on the surface facing the end surface of said coaxial composite member.

8. A method for forming a spherical end surface of a coaxial composite member comprising a cylindrical member having a coaxial bore extending therethrough, and an axial member inserted into said coaxial bore of said cylindrical member to be more readily ground than said cylindrical member, comprising the steps of:

providing a fixedly positioned elongated circularly recessed guide surface of finite length having a recess on the median line thereof, said recess having a predetermined length and a width determined by the diameter of said axial running a grinding tape across said circularly recessed guide surface; and pressing said coaxial composite member on said grinding tape to be then contacted with said circularly recessed guide surface, while rotating said coaxial composite member on its axis on the grinding tape and moving said coaxial composite member reciprocatively on said grinding tape in the direction orthogonal to the running direction of said grinding tape.

9. The method as defined in claim 8, wherein:

the step of pressing said coaxial composite member on said grinding tape comprises the step of:

pressing the end surface of said coaxial composite member to be formed on said grinding tape, in the direction orthogonal to a surface of said grinding tape.

10. The method as defined in claim 8, wherein:

the step of providing said circularly recessed guide surface, comprises the step of:

filling said recess with a material having a hardness lower than the material of said circularly recessed guide surface.

11. The method as defined in claim 8, wherein:

said step of pressing said coaxial composite member comprises the step of:

pressing an optical connector as said coaxial composite member, said optical connector comprising a ferrule as said cylindrical member and an optical fiber as said axial member.

12. The method as defined in claim 8, wherein:

the step of pressing said coaxial composite member on said grinding tape comprises the step of:

bringing said grinding tape into contact with the end surface of said coaxial composite member and with said circularly recessed guide surface.

13. The method as defined in claim 12, wherein:

the step of bringing said grinding tape into contact with the end surface of said coaxial composite member and with said circularly recessed guide surface, comprises the step of:

bringing said grinding tape into contact with said end surface of said coaxial composite member, said grinding tape having a surface coated with grinding grains, said surface coated with grinding grains facing said end surface of said coaxial composite member.

14. The method as defined in claim 13, wherein:

the step of bringing said grinding tape into contact with said end surface of said coaxial composite member comprises the step of:

bringing said grinding tape into contact with said end surface of said coaxial composite member, wherein said surface of said grinding tape facing said end surface is coated with $CeO_2$ grinding grains.

15. The method as defined in claim 13, wherein:

the step of pressing said coaxial composite member on said grinding tape comprises the step of:

applying a pressing force equal to or greater than $10^4$ gf/cm$^2$ to said coaxial composite member; and the step of bringing said grinding tape into contact with said end surface of said coaxial composite member comprises the step of:

bringing said grinding tape into contact with said end surface of said coaxial composite member, wherein said surface of said grinding tape facing said end surface is coated with $SiO_2$ grinding grains.

16. The method as defined in claim 13, wherein:

the step of bringing said grinding tape into contact with said end surface of said coaxial composite member comprises the steps of:

bringing a first grinding tape into contact with said end surface of said coaxial composite member; and bringing a second grinding tape into contact with said end surface of said coaxial composite member.

17. The method as defined in claim 13, wherein:

the step of bringing said grinding tape into contact with said end surface of said coaxial composite member comprises the steps of:

bringing a first grinding tape into contact with said end surface of said coaxial composite member, wherein said surface of said first grinding tape facing said end surface is coated with SiC grinding grains; and bringing a second grinding tape into contact with said end surface of said coaxial composite member, wherein said surface of said second grinding tape facing said end surface is coated with $CeO_2$ grinding grains.

18. The method as defined in claim 13, wherein:

the step of bringing said grinding tape into contact with said end surface of said coaxial composite member comprises the steps of:

bringing a first grinding tape into contact with said end surface of said coaxial composite member, wherein said surface of said first grinding tape facing said end surface is coated with SiC grinding grains; and bringing a second grinding tape into contact with said end surface of said coaxial composite member, wherein said surface of said second grinding tape facing said end surface is coated with diamond grinding grains.

19. A method for forming a spherical end surface of a coaxial composite member comprising a cylindrical member having a coaxial bore extending therethrough, and an axial member inserted into said coaxial bore of said cylindrical member to be more readily ground than said cylindrical member, comprising the steps of:

providing a fixedly positioned elongated circularly recessed guide surface of finite length;

running a grinding tape across said circularly recessed guide surface; and pressing said coaxial composite member on said grinding tape to be then contacted with said circularly recessed guide surface, while rotating said coaxial composite member on its axis on said grinding tape and moving said coaxial composite member reciprocatively on said grinding tape in the direction orthogonal to the running direction of said grinding tape;

wherein the step of running said grinding tape, comprises the step of:

fixing grains of $SiO_2$ on a tape substrate to provide said grinding tape; and the step of pressing said coaxial composite member comprises the step of:

applying a pressing force equal to or greater than $10^4$gf/cm$^2$ axially to said coaxial composite member.

20. The method as defined in claim 19, wherein said step of pressing said coaxial composite member comprises the step of:

pressing an optical connector as said coaxial composite member, wherein said optical connector comprises a ferrule as said cylindrical member and an optical fiber as said axial member.

* * * * *

UNITED STATES PATENT AND TRADEMARK OFFICE

CERTIFICATE OF CORRECTION

PATENT NO. : 6,120,359
DATED : September 19, 2000
INVENTOR(S) : Ohno et al.

It is certified that error appears in the above-identified patent and that said Letters Patent is hereby corrected as shown below:

Column 11,
Line 3, after "axial" insert -- member; --
Line 59, change "$10^4$" to -- 104 --.

Signed and Sealed this

Thirtieth Day of April, 2002

*Attest:*

*Attesting Officer*

JAMES E. ROGAN
*Director of the United States Patent and Trademark Office*